United States Patent [19]

Sadamatsu et al.

[11] 4,346,159

[45] / Aug. 24, 1982

[54] PHOTOSENSITIVE ELEMENT FOR ELECTROPHOTOGRAPHY

[75] Inventors: Shigeru Sadamatsu; Lyon S. Pu; Yoshihisa Ishikawa, all of Kanagawa, Japan

[73] Assignee: Fuji Xerox Co., Ltd., Tokyo, Japan

[21] Appl. No.: 877,783

[22] Filed: Feb. 14, 1978

[30] Foreign Application Priority Data

Feb. 14, 1977 [JP] Japan ..... 52-14152

[51] Int. Cl.[3] ..... G03G 5/14

[52] U.S. Cl. ..... 430/67; 430/66

[58] Field of Search ..... 96/1 R, 1.5, 1.5 N; 430/66, 67, 63, 57, 58, 59

[56] References Cited

U.S. PATENT DOCUMENTS

| | | | |
|---|---|---|---|
| 3,394,001 | 7/1968 | Makino | 96/1.5 |
| 3,481,669 | 12/1969 | Roth et al. | 430/55 |
| 3,532,496 | 10/1970 | Chiang et al. | 96/1.5 |
| 3,653,064 | 3/1972 | Inoue et al. | 96/1.5 |
| 3,692,519 | 9/1972 | Takahashi | 96/1.5 N |
| 3,776,627 | 12/1973 | Ohnishi et al. | 96/1 R |
| 3,801,317 | 4/1974 | Tawaka et al. | 96/1.5 N |
| 3,847,606 | 11/1974 | Schwartz | 96/1.5 N |
| 3,955,978 | 5/1976 | Rochlitz et al. | 96/1.5 |
| 3,982,937 | 9/1976 | Wiedemann | 96/1.5 |
| 4,123,269 | 10/1978 | Von Hoene | 96/1.5 N |

*Primary Examiner*—Richard L. Schilling
*Assistant Examiner*—John L. Goodrow
*Attorney, Agent, or Firm*—Sughrue, Mion, Zinn, Macpeak and Seas

[57] ABSTRACT

A photosensitive element for electrophotography comprising an electrically conductive backing member, a photoconductive layer overlying the backing member, and a transparent electrically insulating surface layer on the photoconductive layer, wherein the transparent electrically insulating surface layer contains a charge-retentive material or a layer of a charge-retentive material is interposed between the photoconductive layer and the transparent electrically insulating surface layer so as to form a charge-retentive layer in the boundary between the photoconductive layer and the transparent electrically insulating layer.

12 Claims, 3 Drawing Figures

PHOTOSENSITIVE ELEMENT FOR ELECTROPHOTOGRAPHY

BACKGROUND OF THE INVENTION

1. Field of the Invention

The invention relates to a photosensitive element composed mainly of an electrically conductive backing member, a photoconductive layer, and a transparent electrically insulating surface layer and, more particularly, to a photosensitive element having a charge-retentive layer in the boundary between the photoconductive layer and the transparent electrically insulating layer.

2. Description of the Prior Art

In the art of electrophotography, a photosensitive element containing a photoconductive layer made of amorphous selenium, zinc oxide, cadmium sulfide, an organic semiconductor, or the like is exposed to a light pattern to form thereon an electrostatic latent image in conformity with the configuration of the original light pattern. The latent image is then developed to form a visible image by the use of toner particles on the surface of the photoconductive layer and is transferred and fixed on a copy sheet. The photoconductive layer surface of such a photosensitive element is subjected to frequent failure and the effective life thereof limited. In order to protect the photoconductive layer from injury, an attempt to provide a transparent electrically insulating protective layer on the photoconductive layer surface has been made, but such an attempt causes an increase in residual potential after a number of copying operations have been repeated and the quality of the final copy obtained is degraded.

U.S. Pat. No. 3,041,167 teaches an electrophotographic element which effectively prevents the increase of the residual potential due to repeated copying operations, which comprises a transparent electrically insulating layer overlying the photoconductive layer so that an electrostatic latent image is produced between the electrically insulating layer and the photoconductive layer. This element is advantageous in that environmental changes do not affect the photoconductive layer, a highly sensitive photoconductive material can be used, and the thickness of the electrically insulating layer has little effect upon the performance of the electrically insulating layer. However, with this element the increase of the residual potential where the electrically insulating layer has a thickness sufficient to protect the photosensitive layer from damage can not be avoided.

An electrophotographic element, which is an improvement over the element described in U.S. Pat. No. 3,041,167 has been proposed in the art where a photosensitive plate composed of an electrically conductive backing member, a photoconductive layer overlying the backing member, a transparent electrically insulating surface layer affixed to the photoconductive layer is first uniformly electrostatically charged across the surface of the transparent electrically insulating layer and is then electrostatically charged a second time at a polarity opposite to that of the first charge or with an alternating current charge and thereafter is exposed to a light pattern to form under the transparent electrically insulating layer an electrostatic latent image in conformity with the configuration of the original light pattern.

This element is further described with reference to the drawings in which FIGS. 1 through 3 show the processes for producing an electrostatic latent image by the use of the element. In FIG. 1, a photosensitive plate composed mainly of an electrically conductive backing member 1, a photoconductive layer 2, and an electrically insulating layer 3 is first electrostatically charged by the use of a corona discharge unit 4. Preferably, the first charge is negative to negatively charge the surface of the transparent electrically insulating layer with a photoconductive layer of the P type and the first charge is positive to positively charge the surface of the transparent electrically insulating layer with a photoconductive layer of the N type. The element will be described hereinafter for simplicity in connection with a P type photoconductive layer. The condition as shown in FIG. 1 can be established by the first electrostatic charge (negative) where no sufficiently large barrier layer exists in the boundary between the backing member and the photoconductive layer and a positive charge is readily injected from the backing member side. The positive charge injected due to the first negative charge is held in the interior of the photoconductive layer in the vicinity of the boundary between the photoconductive layer and the transparent electrically insulating layer. The condition as shown in FIG. 1 can also be established by providing a uniform exposure after or at the same time of the first charge even though no positive charge is injected from the backing member side where the photoconductive layer has an ability to transport positive and negative charges or where the light is absorbed in the entire photoconductive layer. Next, in order to leave the charge only in the boundary between the photoconductive layer and the transparent electrically insulating layer, the photosensitive plate is given a second AC charge or a second charge having a polarity opposite to that of the first charge by the use of another corona discharge unit 5 to remove the charge on the surface of the transparent electrically insulating layer. As a result, the condition as shown in FIG. 2 is established. After the second charge, the photosensitive plate is exposed to a light pattern as shown in FIG. 3 to produce thereon an electrostatic latent image, which is then developed and transferred. Thereafter, the photosensitive plate is given an AC charge and at the same time is uniformly exposed.

Although the electrophotographic process is superior in stability relative to repeated operations, a large corona charging current is required in comparison with the conventional Carlson process. That is, in the electrophotographic process, the positive charge injected from the backing member due to the first negative charge is held in the interior in the vicinity of the boundary between the photoconductive layer and the transparent electrically insulating layer, and the part of the charge held in the vicinity of the boundary is released as the charge on the surface of the electrically insulating layer is removed due to the second charge. Therefore, a large corona charging current is required to obtain a constant contrast in comparison with the conventional Carlson process.

SUMMARY OF THE INVENTION

An object of the present invention is to improve the charging performance of a photosensitive element composed mainly of an electrically conductive backing member, a photoconductive layer, and a transparent electrically insulation layer.

Another object of the present invention is to provide a charge-retentive layer in the boundary between the transparent electrically insulating layer and the photoconductive layer to prevent the charge held in the boundary due to a first charge from discharging.

The above objects are attained in accordance with the present invention by providing a transparent electrically insulating surface layer containing a charge-retentive material (an electron donating compound or an electron donating dye) or by providing a layer of the charge-retentive material between the transparent electrically insulating surface layer and the photoconductive layer.

Accordingly, this invention provides a photosensitive element for electrophotography comprising an electrically conductive backing member, a photoconductive layer on the backing member, and a transparent electrically insulating surface layer on the photoconductive layer, with the transparent electrically insulating surface layer containing a charge-retentive material or a layer of a charge-retentive material interposed between the photoconductive layer and the transparent electrically insulating surface layer, whereby a charge-retentive layer in the boundary between the photoconductive layer and the transparent electrically insulating layer is formed.

BRIEF DESCRIPTION OF THE DRAWING

In FIGS. 1 through 3 are views showing an electrostatic latent image produced on a photosensitive element through charge and light pattern exposure steps in the conventional electrophotographic process improved over the process described in U.S. Pat. No. 3,041,167 wherein 1 is an electrically conductive backing member; 2 is a photoconductive layer; 3 is a transparent electrically insulating layer; 4 is a first charging unit; 5 is a second charging unit; and 6 is an image pattern.

DETAILED DESCRIPTION OF THE INVENTION

Figure 1:
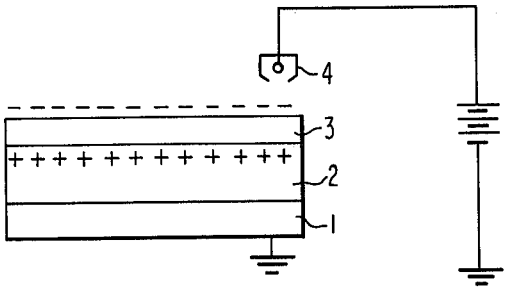
Figure 1:
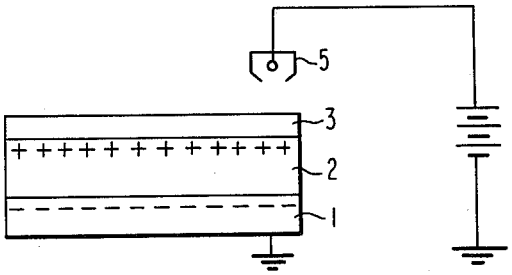
Figure 1:
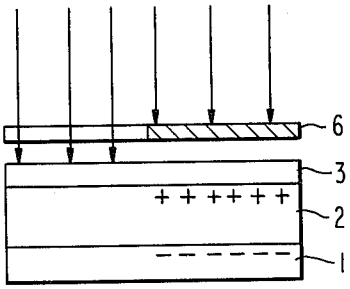

The present invention has for an object the improvement of the electrical characteristics, particularly, the charging performance of a three-layer photosensitive element by providing a photosensitive element composed of an electrically conductive backing member, a photoconductive layer, and a transparent electrically insulating layer, the transparent electrically insulating layer containing a charge-retentive material or a layer of the charge-retentive material is interposed between the photoconductive layer and the transparent electrically insulating surface layer so as to form a charge-retentive layer in the boundary between the photoconductive layer and the transparent electrically insulating layer.

A suitable amount of the charge-retentive electron donating compound which can be present in the transparent electrically insulating layer when the charge-retentive electron donating compound is present therein is about 0.01 to about 30% by weight, preferably 0.1 to 10% by weight.

When a layer of the charge-retentive material is employed, the charge-retentive material can be simply coated as a layer thereof or can be mixed with a binder, etc. and then coated.

A suitable thickness of the separate layer of the charge-retentive material is about 0.01 to about 15$\mu$, preferably 0.1 to 5$\mu$.

The term "electrically insulating" as used in the description given throughout the specification and as used in the appended claims means that the material has an electric resistance higher than about $10^{13}$ $\Omega$·cm.

The photosensitive element of the present invention is suitable for application to an electrophotographic system employing a photosensitive element having a transparent insulating layer overlying a photoconductive layer as described in U.S. Pat. Nos. 3,041,167 and 3,666,363, corresponding to Japanese Patent Publication No. 23910/1967, and Japanese Patent Publication No. 2627/1968 and particularly, it is suitable for application to an electrophotographic system improved from the system disclosed in U.S. Pat. No. 3,041,167.

Preferably, the charge-retentive material is an electron donating compound which can be selected from the following compounds:

a condensed polycyclic compound such as naphthalene, anthracene, chrysene, pyrene, or the like, an amine and a quaternary amine compound such as trimethylamine, tetramethyl ammonium ion, or the like, an aniline derivative such as aniline, N,N-dimethylaniline, phenylenediamine, benzidine, tetramethyl-p-phenylenediamine, aminonaphthalene, or the like, a nitrogen-containing heterocyclic compound such as pyrrole, pyrazole, triazole, pyridine, pyridazine, pyrazine, triazine, indole, quinoline, cinnoline, naphtylidine, carbazole, acridine, purine, phenadine, derivatives thereof, or the like, a sulfur containing heterocyclic compound such as thiophene, dithiol, thionaphthene, derivatives thereof, or the like, an oxygen-containing heterocyclic compound such as furan, pyran, pyrone, coumarin, xanthene, derivatives thereof, or the like, a nitrogen- and oxygen-atom containing heterocyclic compound such as oxazole, oxadiazole, oxatriazole, dioxazole, oxazine, isoxazine, oxadiazine, morpholine, pyranopyrrole, indoxazine, benzoxazole, anthranyl, benzoxazine, phenoxazine, derivatives thereof, or the like, a nitrogen- and sulfur-atom containing heterocyclic compound such as thiazole, phenothiazine, derivatives thereof, or the like, an oxygen- and sulfur-atom containing heterocyclic compound such as an oxathiol derivative, or the like, and a sulfur-, nitrogen-, and oxygen-atom containing heterocyclic compound such as oxathiazole, oxathiazine, derivatives thereof, or the like.

Any electron donating dyes can be used for the charge-retentive material which can be selected from the following dyes:

Nigrothin, Methylene Blue, Indigo Blue, Congo Red, Victoria Pure Blue, Violet 6B, Fuchsin, Basic Cyanine LG, Auramine, Naphthalene Green, Acid Rhodamine G, Fluorescin, Rose Bengal, Eosin A, Eosin Y, Pholoxine Pinakryptol Green, Celestine Blue, Quinoline Blue, cyanine dyes, Oil Red B, Chrome Blue, Blue Black RG.

A photoconductive layer is coated with a coating material containing an electron donating compound in a thickness of about 10 to about 40$\mu$ and is dried to prepare a photosensitive element. The prepared photosensitive element is then employed in the process improved over the electrophotographic process as described in U.S. Pat. No. 3,041,167 to test the effect of the electron donating material on the charge retentivity. The corona charge current through the photosensitive element with its electrically insulating layer containing the electron donating material is lower in value than the photosensitive element without any electron donating material. It has been found experimentally that the electron donating material has a function of increasing the charge retentivity of the photosensitive element.

Similar results are obtained on a photosensitive element having an electron donating material layer interposed between the electrically insulating layer and the photoconductive layer by the use of adsorption or vacuum deposition. The photoconductive layer of the three-layer photosensitive element may be a homogeneous layer of a single material such as Se, a Se-Te alloy, a Se-Te-Tl alloy, a Se-As alloy, a Se-As-Cl alloy, or an organic photoconductor or the phtoconductive layer thereof may be a composite layer containing photoconductive particles such as ZnO, CdS, or CdSe particles and a resin binder such as a thermoplastic resin or a thermosetting resin.

Suitable examples of organic photoconductors which can be used in the present invention include polyvinyl carbazole, polyvinyl anthracene, polyindene, polyacenaphthene, polyvinyl naphthalene, polyvinyl quinoline, phthalocyanine, quinacridone, vinylanthracene and the like. Suitable inorganic photoconductors which can be used are as described above, e.g., Se, a Se-Te alloy, a Se-Te-Tl alloy, a Se-As alloy, a Se-As-Cl alloy ZnO, Cds, CdSe, etc.

Suitable examples of resin binders which can be used in the present invention include (1) thermosetting resins, e.g., phenol resins, epoxy resins, polyurethane setting-type resins, urea resins, melamine resins, alkyd resins, silicone resin, acrylic-type reactive resins, etc., and (2) thermoplastic resins, e.g., polyolefin resins, styrene resins, polyvinyl resins, polyacrylate resins, etc.

The transparent electrically insulating layer is preferably made of a material having a high dielectric breakdown strength and abrasion resistance such as, for example, a polysiloxane, a polyurethane, a polyester, a polyethyleneoxide, a polyethylene terephthalate, a polyethylene, a polyoxyethylene, a polycarbonate, a polystyrene, a polyphenylether, a polyphenylene, a polypeptide, an ABS resin, an AS resin, an epoxy resin, a polyvinyl chloride, a polyacetal, a polyamide, a urea resin, a melamine resin, an acrylic resin, and copolymers of the monomers present in these polymers. A suitable thickness for the transparent electrically insulating layer is about 10 to about 50μ.

Suitable examples of electrically conductive backing members which can be used in the present invention are metals, e.g., aluminum, nickel, platinum, etc., and papers or synthetic resins which have been treated to render them electrically conductive.

The photosensitive element of this invention can be employed in electrophotographic processes, e.g., as described in U.S. Pat. No. 3,041,167.

The following Examples are given to further specifically define specific embodiments of the photosensitive element of the present invention. Unless otherwise indicated herein, all parts, percents, ratios and the like are by weight.

EXAMPLE 1

A Se-As (100:0.5) alloy was coated on an aluminum drum in a thickness of about 60μ by vacuum deposition and was further coated with a coating material containing 100 parts by weight of Vinyloze (a kind of vinyl chloride resin, a trademark of Dai-Nippon Toryo Co., Ltd.), 80 parts by weight of thinner, and 0.1 part by weight of Nigrothinbase mixed just before the coating using a spray gun to a thickness of about 20μ. This coating was dried at about 50° C. for 30 minutes and left at room temperature (about 20°-30° C.) for several days (i.e., 2 days) to prepare a photosensitive element. The photosensitive element was subjected to the steps of negatively charging, exposure, positively charging, exposure to a light pattern and a high quality copy was obtained. The corona charge currents of the first charge and the second charge required to obtain an image potential contrast of 800 V were −120 μA and +62 μA, respectively.

EXAMPLE 2

Similar procedures as described in Example 1 were carried out but using Methylene Blue in place of the Nigrothinbase in Example 1. The corona charge currents of the first charge and the second charge required to obtain an image potential contrast of 800 V were −173 μA and +86 μA, respectively.

EXAMPLE 3

Similar procedures as described in Example 1 were carried out but using Methylene Blue in place of the Nigrothinbase in Example 1. The corona charge currents of the first charge and the second charge required to obtain an image potential contrast of 800 V were −190 μA and +90 μA, respectively.

EXAMPLE 4

The procedures of Example 1 were repeated and o-phenylenediamine was used as an electron donating material. The corona charge currents of the first charge and the second charge to obtain an image potential contrast of 800 V were −136 μA and +70 μA, respectively.

EXAMPLE 5

The procedures of Example 4 were repeated and N-methyl morpholine was used as electron donating compound. The corona charge currents of the first charge and the second charge to obtain an image potential contrast of 800 V were −192 μA and +96 μA, respectively.

EXAMPLE 6

The procedures of Example 4 were repeated and benzidine was used as the electron donating compound. The corona charge currents of the first charge and the second charge to obtain an image potential contrast of 800 V were −168 μA and +85 μA, respectively.

EXAMPLE 7

The procedures of Example 4 were repeated and tetramethyl-p-phenylenediamine was used as the electron donating compound. The corona charge currents of the first charge and the second charge to obtain an image potential contrast of 800 V were −132 μA and +67 μA, respectively.

EXAMPLE 8

An aluminum drum coated with a Se-As (100:0.5) alloy in a thickness of about 60μ by vacuum deposition was placed in a 5% solution of Nigrothinbase in isopropanol for about 30 minutes and then was washed in an isopropanol solution, dried, coated with the Vinyloze solution as described in Example 1 using a spray gun, and dried. Procedures similar to those of Example 1 were carried out. The corona charge currents of the first charge and the second charge to obtain an image potential contrast of 800 V were −168 μA and +84 μA, respectively.

COMPARISON EXAMPLE

The procedures of Example 1 were carried out with an electrically insulating layer which did not contain an electron donating material. The corona charge currents of the first charge and the second charge to obtain an image potential contrast of 800 V were −200 μA and +100 μA, respectively.

While the present invention has been described herein in connection with a P type photoconductor, it is to be understood that an N type photoconductor may be used with a charge of a polarity opposite that applied to the P type photoconductor to convert an electron donating material to a positive hole donating material with a similar charge retentivity being obtained. Suitable examples of positive hole donating materials which can be used in the present invention include a halogen and a Lewis acid, i.e., a compound containing therein a cyano group, a nitro group, a halogen atom, an acid moiety or a quinone group (e.g., tricyanobenzole, dicyanonaphthalene, tetracyanoethylene, tetracyanoquinodimethane, tetrafluorenone, trinitroanisole, trinitrofluorenone, trinitrobenzole, chloronitrobenzoic acid, dinitrochloronaphthalene, anthraquinone, dichloroquinone, etc.).

As described hereinbefore, the photosensitive element in accordance with the present invention can be used to reduce the corona charge current value of the first charge, reduce the density of ozone exhausted into the air, and increase the effective life of the electrically insulating layer of the photosensitive element.

While the invention has been described in detail and with reference to specific embodiments thereof, it will be apparent to one skilled in the art that various changes and modifications can be made therein without departing from the spirit and scope thereof.

What is claimed is:

1. A photosensitive element for electrophotography having improved charging performance and comprising an electrically conductive backing member, a photoconductive layer having an electric resistance of greater than about $10^{13}$ Ω·cm and a thickness of about 10 to about 50μ on the backing member, and a transparent electrically insulating surface layer on the photoconductive layer, wherein the transparent electrically insulating surface layer contains a an electron donating compound in an amount of 0.01 to 30% by weight or a layer of an electron donating compound about 0.01 to about 15μ thick interposed between the photoconductive layer and the transparent electrically insulating surface layer, whereby a charge-retentive layer is formed in the boundary between the photoconductive layer and the transparent electrically insulating layer to prevent a charge held in the boundary between the photoconductive layer and the transparent electrically insulating layer from discharging, wherein a positive-type photoconductor is used as the photoconductive layer, further wherein said transparent electrically insulating layer is a layer of a member selected from the group consisting of a polysiloxane, a polyurethane, a polyester, a polyethyleneoxide, a polyethylene terephthalate, a polyethylene, a polyoxyethylene, a polycarbonate, a polystyrene, a polyphenylether, a polyphenylene, a polypeptide, an acrylonitrile/butadiene/styrene resin, an acrylonitrile/styrene resin, an apoxy resin, a polyvinyl alcohol, a polyacetal, a polyamide, a urea resin, a melamine resin, an acrylic resin or a copolymer thereof and wherein said electron donating compound is selected from the group consisting of Nigrothin, Methylene Blue, Indigo Blue, Congo Red, Victoria Pure Blue, Violet 6B, Fuchsin, Basic Cyanine LG, Auramine, Naphthalene Green, Acid Rhodamine G, Fluorescin, Rose Bengal, Eosin A, Eosin Y, Pholoxine Pinakryptol Green, Celestine Blue, Quinoline Blue, cyanine dyes, Oil Red B, Chrome Blue, Blue Black RG, a condensed polycyclic compound, an amine compound, a quaternary amine compound, an aniline derivative, a nitrogen-containing heterocyclic compound, a sulfur-containing heterocyclic compound, an oxygen-containing heterocyclic compound, a nitrogen- and oxygen-atom containing heterocyclic compound, a nitrogen- and sulfur-atom containing heterocyclic compound, an oxygen- and sulfur-atom containing heterocyclic compound or a sulfur-, nitrogen- and oxygen-atom containing heterocyclic compound.

2. The photosensitive element of claim 1, wherein said electron donating compound is an electron donating dye selected from the group consisting of Nigrothin, Methylene Blue, Indigo Blue, Congo Red, Victoria Pure Blue, Violet 6B, Fuchsin, Basic Cyanine LG, Auramine, Naphthalene Green, Acid Phodamine G, Fluoremin, Rose Bengal, Eosin A, Eosin Y, Pholoxine Pinakryptol Green, Celestine Blue, Quinoline Blue, cyanine dyes, Oil Red B, Chrome Blue and Blue Black RG.

3. The photosensitive element of claim 1, wherein said electron donating compound is selected from the group consisting of a condensed polycyclic compound, an amine compound, a quaternary amine compounds, an aniline derivative, a nitrogen-containing heterocyclic compound, a sulfur-containing heterocyclic compound, an oxygen-containing heterocyclic compound, a nitrogen- and oxygen-atom containing heterocyclic compound, a nitrogen- and sulfur-atom containing heterocycluc compound, an oxygen- and sulfur-atom containing heterocyclic compound or a sulfur-, nitrogen- and oxygen-atom containing heterocyclic compound.

4. The photosensitive element of claim 1, wherein said photoconductive layer comprises a layer of an inorganic photoconductor or an organic photoconductor or a layer of particles of an inorganic photoconductor or an organic photoconductor in a resin binder.

5. The photosensitive element of claim 1, wherein when said electron donating compound is present in said transparent electrically insulating layer it is present in an amount of 0.1 to 10% by weight, and when present as a separate layer said separate layer has a thickness of 0.1 to 5μ.

6. The photosensitive element of claim 1, wherein the transparent electrically insulating surface layer contains said electron donating compound.

7. The photosensitive element of claim 1, wherein said layer of an electron donating compound is interposed between the photoconductive layer and the transparent electrically insulating surface layer.

8. The photosensitive element of claim 1, wherein said electron donating compound is selected from the group consisting of naphthalene, anthracene, chrysene and pyrene.

9. The photosensitive element of claim 1, wherein said electron donating compound is selected from the group consisting of aniline, N,N-dimethylaniline, phenylenediamine, benzidene, tetramethyl-p-phenylenediamine and aminonaphthalene.

10. The photosensitive element of claim 1, wherein said electron donating compound is selected from the group consisting of thiopene, dithiol and thionaphthene.

11. The photosensitive element of claim 1, wherein said electron donating compound is selected from the group consisting of furan, pyran, pyrone, coumarin and xanthene.

12. The photosensitive element of claim 1, wherein said electron donating compound is selected from the group consisting of oxazole, oxadiazole, oxatriazole, dioxazole, oxazine, isoxazine, oxadiazine, morpholine, pyranopyrrole, indoxazine, benzoxazole, anthranyl, benzoxazine and phenoxazine.

* * * * *